United States Patent [19]

Biard et al.

[11] 4,443,270

[45] Apr. 17, 1984

[54] RINSE AID COMPOSITION

[75] Inventors: Daniel Biard, Böhl-Iggelheim, Fed. Rep. of Germany; Rainer Lodewick, Meise, Belgium

[73] Assignee: The Procter & Gamble Company, Cincinnati, Ohio

[21] Appl. No.: 397,329

[22] Filed: Jul. 12, 1982

[30] Foreign Application Priority Data

Jul. 17, 1981 [GB] United Kingdom ..... 8122039

[51] Int. Cl.[3] ..... A47L 15/44; B67C 1/04; C11D 1/66; C11D 3/04

[52] U.S. Cl. ..... 134/25.2; 134/26; 134/29; 252/89.1; 252/173; 252/174.21; 252/DIG. 1; 252/DIG. 10

[58] Field of Search ..... 252/89.1, 99, 133, 135, 252/174.21, DIG. 10, DIG. 1; 134/25.2, 26, 29

[56] References Cited

U.S. PATENT DOCUMENTS

| | | | |
|---|---|---|---|
| 2,447,297 | 1/1942 | Wegst et al. | 134/25 A |
| 3,255,117 | 6/1966 | Knapp et al. | 252/99 |
| 3,514,304 | 5/1970 | Binnis | 106/300 |
| 3,563,901 | 2/1971 | Crotty | 252/136 |
| 3,677,820 | 7/1972 | Rutkowski | 252/135 |
| 3,981,741 | 9/1976 | Iino | 134/6 |
| 4,129,515 | 12/1978 | Foster | 252/117 |
| 4,145,303 | 3/1979 | Loudas | 252/156 |
| 4,235,758 | 11/1980 | Dawson | 252/544 |
| 4,381,246 | 4/1983 | Anderson | 252/91 |

FOREIGN PATENT DOCUMENTS

| | | |
|---|---|---|
| 2539531 | 3/1977 | Fed. Rep. of Germany . |
| 1517029 | 7/1978 | United Kingdom . |

*Primary Examiner*—Dennis L. Albrecht
*Attorney, Agent, or Firm*—Edmund F. Gebhardt; Thomas H. O'Flaherty; Richard C. Witte

[57] ABSTRACT

A liquid rinse aid for use in automatic dishwashing machines comprises a low foaming ethoxylated non-ionic surfactant, an organic chelating agent, a hydrotrope-water solubilizing system and 0.1–10%, by weight of the rinse aid, of magnesium, zinc, tin, bismuth or titanium ions, added in the form of a water soluble salt.

2 Claims, No Drawings

RINSE AID COMPOSITION

FIELD OF THE INVENTION

This invention relates to rinse aid compositions for use in automatic dishwashing machines of both industrial and domestic type.

BACKGROUND OF THE INVENTION

Automatic dishwashing (hereinafter ADW) machines employ a variety of wash cycles, or in the case of commercial practice, a variety of machine stages, which usually include a pre rinse, one or more spray washings using an aqueous detergent solution, and one or more rinses to remove residual detergent and loosened soil. In the majority of modern machines, a rinse aid composition is added, via a separate dispenser, to the final rinse cycle or stage, which composition serves to promote wetting, enhance sheet flow production and increase the rate of water drainage, thereby reducing water spotting on the washed and dried tableware. The rinse aid, which is liquid, contains a low foaming nonionic surfactant and a chelating agent in a hydrotrope-water solubilising system.

In areas where the water supply has a low level of mineral hardness i.e. $\leqq 50$ ppm expressed as $CaCO_3$, or in ADW machines whose water supply is presoftened, it has been noticed that glassware subjected to repetitive washing in an ADW machine develops a surface cloudiness which is irreversible. This cloudiness often manifests itself as an iridescent film that displays rainbow hues in light reflected from the glass surface and the glass becomes progressively more opaque with repeated treatment. Whilst the source of this cloudiness is not completely understood, it is believed that it arises from chelating agent carried over from the wash or contained in the rinse aid, attacking the glass surface during the final rinse or the subsequent drying step.

The corrosion of glass by detergents is a well known phenomenon and a paper by D. Joubert and H. Van Daele entitled "Etching of glassware in mechanical dishwashing" in Soap and Chemical Specialities, March 1971 pp62, 64 and 67 discusses the influence of various detergent components particularly those of an alkaline nature. Zinc salts incorporated as components of the detergent compositions are stated to have an inhibitory effect on their corrosive behaviour towards glass.

This subject is also discussed in a paper entitled "The present position of investigations into the behaviour of glass during mechanical dishwashing" presented by Th. Altenschoepfer in April 1971 at a symposium in Charleroi, Belgium on "The effect of detergents on glassware in domestic dishwashers". In the paper the use of zinc ions in the detergent compositions used to wash glsss was stated to provide too low a "preservation factor". A similar view was also expressed in another paper delivered at the same symposium by P. Mayaux entitled "Mechanism of glass attack by Chemical Agents".

Rutkowski U.S. Pat. No. 3,677,820 discloses the use of metallic zinc or magnesium strips in automatic dishwashing machines to inhibit glassware corrosion caused by the alkaline detergent solution, and the incorporation of calcium, beryllium, zinc and aluminum salts into ADW detergent compositions for the same purpose is disclosed in U.S. Pat. Nos. 2,447,297 and 2,514,304, German DTOS No. 2,539,531 and B.P. No. 1,517,029. None of the above references discuss the corrosion of glass arising from treatment with a solution of a chelating agent in water of low mineral hardness and close to neutral pH, such as takes place when a conventionally formulated rinse aid is added to the final rinse stage of an ADW machine cycle. It has surprisingly been found that the addition of water soluble Zn or magnesium salts to the final rinse substantially eliminates this soft water corrosion.

SUMMARY OF THE INVENTION

Accordingly, the present invention provides a liquid rinse aid composition for use in an automatic dishwashing machine comprising from about 1% to about 40% by weight of a low foaming ethoxylated nonionic surfactant, from 0% to about 30% by weight of an orgranic chelating agent and a hydrotrope-water solubilising system wherein the composition comprises from about 0.1% to about 10% by weight of polyvalent metal ions selected from the group consisting of $Mg^{++}$, $Zn^{++}$, $Bi^{+++}$, $Ti^{+++}$, $Sn^{++++}$, and $Sn^{++}$ ions and mixtures thereof, said ions being present in the form of a water soluble salt thereof.

DETAILED DESCRIPTION OF THE INVENTION

Rinse aid compositions in accordance with the invention comprise a low foaming ethoxylated nonionic surfactant, normally an organic chelating agent, a water soluble magnesium, zinc, tin, bismuth or titanium salt and an aqueous solubilising system.

Nonionic surfactants which are advantageously employed in the composition of this invention include, but are not limited to, the following polyoxyalkylene nonionic detergents: $C_8$–$C_{22}$ normal fatty alcohol-ethylene oxide condensates i.e., condensation products of one mole of a fatty alcohol containing from about 8 to about 22 carbon atoms with from about 2 to about 20 moles of ethylene oxide; polyoxypropylene-polyoxyethylene condensates having the formula $$HO(C_2H_4O)_x(C_3H_6O)_y(C_2H_4O)_{x1}H$$

wherein y equals at least about 15 and $(C_2H_4O)_{x+x\ 1}$ equals from about 20% to about 90% of the total weight of the compound; alkyl polyoxypropylenepolyoxyethylene condensates having the formula $RO—(C_3H_6O)_x(C_2H_4O)_yH$ where R is an alkyl group having from 1 to about 15 carbon atoms and x and y each represent an integer from about 2 to about 98; polyoxyalkylene glycols having a plurality of alternating hydrophobic and hydrophilic polyoxyalkylene chains, the hydrophilic chains consisting of linked oxyethylene radicals and the hydrophobic chains consisting of linked oxypropylene radicals, said product having three hydrophobic chains, linked by two hydrophilic chains, the central hydrophobic chain constituting from about 30% to about 34% by weight of the product, the linking hydrophilic chains together constituting from about 31% to about 35% by weight of the product, the intrinsic viscosity of the product being from about 0.06 to about 0.09 and the molecular weight being from about 3,000 to about 5,000 (all as described in U.S. Pat. No. 3,048,548); butylene oxide capped alcohol ethoxylates having the formula $$R(OC_2H_4)_y(OC_4H_8)_xOH$$

where R is an alkyl group containing from about 8 to about 18 carbon atoms and y is from about 3.5 to about 10 and x is from about 0.5 to about 1.5; benzyl ethers of polyoxyethylene condensates of alkyl phenols having the formula

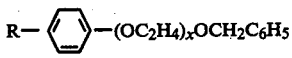

where R is an alkyl group containing from about 6 to about 20 carbon atoms and x is an integer from about 5 to about 40; and alkyl phenoxy polyoxyethylene ethanols having the formula

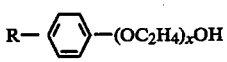

where R is an alkyl group containing from about 8 to about 20 carbons atoms and x is an integer from about 3 to about 20. Other nonionic detergents are suitable for use in the herein disclosed rinse aid compositions and it is not intended to exclude any detergent possessing the desired attributes.

Preferred nonionic surfactants are the condensates of from about 2 to about 15 moles of ethylene oxide with one mole of a $C_8$–$C_{20}$ aliphatic alcohol. Particularly preferred surfactants are those based on ethylene oxide condensates with primarily aliphatic alochols made by the "oxo" process. These alcohols are predominantly straight-chain aliphatic alcohols, with up to about 25% of short-chain branching at the 2-position. A suitable range of alcohol ethoxylates is made by the Shell Chemical Company and is sold under the trade name "Dobanol". A particularly preferred material of this type is Dobanol 45-4, which is the reaction product of 4 moles of ethylene oxide with 1 mole of a $C_{14}$–$C_{15}$ oxo-alcohol. Another preferred commercially available range of surfactants is based on the ethoxylates of relatively highly branched alcohols, containing up to 60% of $C_1$–$C_6$ branching at the 2-position. These alcohols are sold under the trade name "Lial" by Liquichimica Italiana. A preferred material is Lial 125-4, the condensation product of 4 moles of ethylene oxide with a $C_{12}$–$C_{15}$ alcohol.

Further examples of suitable nonionic surfactants can be found in B.P. No. 1,477,029.

The level of nonionic surfactant can be from about 1% to about 40% by weight, preferably from about 10% to about 25% by weight of the rinse aid.

The chelating agent can be any one of a wide range of organic or inorganic sequestering agents, examples including phosphoric acid, amino polycarboxylic acids such as EDTA, NTA and DETPA and polycarboxylic acids such as lactic acid, citric acid, tartaric acid, gluconic acid, glucoheptonic acid, mucic acid, galactonic acid, saccharic acid, fumaric acid, succinic acid, glutaric acid, adipic acid and their alkali metal or ammonium salts. Citric or tartaric acid are preferred chelating acids. The chelating agent if included is present in an amount of up to about 30% and normally lies in the range from about 5% to about 20% by weight. Highly preferred compositions use from about 5% to about 10% by weight of chelating agent in order to minimise any attack by the chelating agent on the glass.

Any water soluble salt of magnesium, zinc, tin, bismuth or titanium may be used as a source of the respective metal ions. The chloride, sulphate or acetate of zinc and magnesium may be used although the chloride is preferred for reasons of convenience and economy. Tin can be used in either the stannic or stannous salt form with chloride being the preferred anion. Bismuth lactate is the preferred bismuth salt by reason of its appreciable solubility. Titanium can also be used in the form of a chloride but titanium oxysulphate has also been found to be a suitable salt. The level of salt is selected so as to provide from about 0.1% to about 10% of metal ions. For the preferred magnesium and zinc salts this corresponds to approximately 0.2%–20% $ZnCl_2$ and 0.5%–53% $MgCl_26H_2O$. Normally the range of metal ion content is from about 1% to about 10% and preferably is from about 2% to about 5% corresponding to 4–10% $ZnCl_2$ and 10–26% $MgCl_26H_2O$.

The balance of the rinse aid formulation comprises a solubilising system which is water optionally together with from about 1% to about 25% preferably from about 2% to about 20% by weight of the composition of hydrotrope which may be ethanol, isopropanol, a lower alkyl benzene sulphonate such as toluene, xylene or cumene sulphonate or a mixture of any of these.

The order of addition of the various ingredients of the formulation is not critical. Most conveniently the formulations are made by forming a solution of the hydrotrope in water and then adding the metal salt, surfactant and chelating agent (if present) in any desired order.

The invention is illustrated in the following examples in which all percentages are by weight of the composition.

EXAMPLE I

Two ADW detergent compositions and their companion rinse aid products were formulated and are shown below as I and RAI and II and RAII respectively.

| | | |
|---|---|---|
| Sodium Metasilicate | 15.0 | 43.0 |
| Sodium Tripolyphosphate | 70.0 | 39.5 |
| Sodium dichloroisocyanurate | 2.0 | 2.0 |
| Nonionic surfactant | 1.0[1] | 1.5[1] |
| Sodium carbonate | — | 7.5 |
| Sodium sulphate | 5.0 | 2.5 |
| Water & Miscellaneous | 7.0 | 4.0 |
| Nonionic surfactant | 20.0[2] | 10.0[3] |
| Citric acid monohydrate | 20.0 | 19.5 |
| Sodium cumene sulphonate | 4.0 | — |
| Sodium xylene sulphonate | — | 3.0 |
| Water & Miscellaneous | 56.0 | 67.5 |

Nonionic Surfactant 1. 67.5% $C_{13}$ 32.5% $C_{15}$ primary aliphatic alcohol condensed with 3 moles ethylene oxide and 4 moles propylene oxide per mole of alcohol. The order of addition of the various ingredients of the formulation is not critical. Most conveniently the formulations are made by forming a solution of the hydrotrope in water and then adding the metal salt, surfactant and chelating agent (if present) in any desired order.

2. 67.5% $C_{13}$ 32.5% primary aliphatic condensed with 5.75 moles of ethylene oxide and 2.85 moles propylene oxide per mole of alcohol.

3. Pluronic L 61a polyoxyethylene polyoxypropylene condensates available from BASF Wyandotte Corporation.

Test loads of glasses comprising 3 soda glasses and 1 crystal glass were subjected to washing cycles in a Miele De Luxe G550 ADW machine, using the above products. The short programme setting on the machine was selected as this had previously been found to emphasise differences between products. This program consists of one mainwash with a cool-down step at the end, one final rinse and a drying step. The maximum temperature reached during the wash is approximately 60° C. and the whole program takes between 45 and 60 minutes.

Product usage was 40 g detergent product and 3.5–4 g rinse aid dispensed automatically.

Results of multi cycle washing with the products are shown below. In experiments 1 and 2 the machine was stopped at the end of the wash stage and reset to commence a fresh cycle, eliminating the rinse and drying stages.

| | Detergent | Rinse Aid | Water Hardness ppm $CaCO_3$ | Iridescent film after # washes 25 | 50 | 75 |
|---|---|---|---|---|---|---|
| 1 | I | none | 17 | none | | |
| 2 | II | none | 17 | none | | |
| 3 | I | RAI | 17 | strong | | |
| 4 | II | RAII | 17 | strong | | |
| 5 | I | RAI | 40 | none | strong | |
| 6 | II | RAII | 40 | none | strong | |
| 7 | I | RAI | 60 | none | none | |
| 8 | II | RAII | 60 | none | none | |

It can be seen that in the absence of a rinse stage, no corrosion occurs and that the corrosive effect is diminished with increasing water hardness, irrespective of product formulation.

RAI was then modified to reduce the citric acid monohydrate level to 10% acid and further experiments carried out with additions to the modified rinse aid as shown below.

| | Detergent | Rinse Aid | Water Hardness ppm $CaCO_3$ | Iridescent film after # washings 25 | 50 | 75 |
|---|---|---|---|---|---|---|
| 9 | I | RAI Mod | 17 | strong | | |
| 10 | I | RAI + 8% $MgCl_26H_2O$ | 17 | slight | | |
| 11 | I | RAI + 16% $MgCl_26H_2O$ | 17 | none | v slight | slight |
| 12 | I | RAI + 1% $ZnCl_2$ | 17 | strong | | |
| 13 | I | RAI + 5% $ZnCl_2$ | 17 | none | none | none |
| 14 | I | RAI + 10% $ZnCl_2$ | 17 | none | | |

From experiments 10, 11, 13 and 14 employing compositions in accordance with the invention, it can be seen that the addition of either $MgCl_26H_2O$ in an amount greater than approximately 5% by weight or $ZnCl_2$ in an amount greater than approximately 2% by weight causes a marked improvement in the resistance of the glass to corrosion.

EXAMPLE 2

Further experiments were carried out in which the following product systems were compared System A Product II with Rinse Aid RAI modified as in experiment 13 above (i.e. including 5% $ZnCl_2$)
System B Product II with Rinse Aid RAII
Conditions: Miele G550 Short programme 40 g detergent product usage 3.5–4 g rinse aid usage (automatically dispensed) water hardness 17 ppm $CaCO_3$

| | Cycles 25 | | 50 | | 125 | |
|---|---|---|---|---|---|---|
| | system | | | | | |
| Glass | A | B | A | B | A | B |
| (soda/lime glass) | OK | slight colouring cloudy spots | OK | colouring | OK | strong colouring + etching |
| (crystal glass) | OK | strong colouring | OK | strong colouring | OK | strong colouring |
| (crystal glass) | OK | strong colouring | OK | strong colouring | OK | strong colouring + etching |
| (hand made low lead | OK | strong colouring cloudy spots | OK | strong colouring | OK | strong colouring |

-continued

System A Product II with Rinse Aid RAI modified as in experiment 13 above (i.e. including 5% $ZnCl_2$)
System B Product II with Rinse Aid RAII
Conditions: Miele G550 Short programme 40 g detergent product usage 3.5–4 g rinse aid usage (automatically dispensed) water hardness 17 ppm $CaCO_3$

| | Cycles | | | | | |
|---|---|---|---|---|---|---|
| | 25 | | 50 | | 125 | |
| | system | | | | | |
| Glass | A | B | A | B | A | B |
| crystal glass) (high lead crystal glass) | OK | slight colouring | OK | + etching slight colouring | OK | + etching colouring |

In each case above, system A, embodying a rinse aid composition in accordance with the invention, is shown to prevent the glassware corrosion.

We claim:

1. In a process for rinsing tableware in an automatic dishwashing machine wherein the rinse solution contains a low foaming ethoxylated nonionic surfactant to reduce spotting on washed and dried tableware and said rinse solution contains 50 ppm or less of water hardness measured as $CaCO_3$ and has a pH close to neutral, wherein the improvement comprises the addition of a source of water-soluble $Mg^{++}$ or $Zn^{++}$ ions to said rinse solution with said low foaming ethoxylated nonionic surfactant whereby corrosion of glass arising from the presence of chelating agents in automatic dishwashing detergent compositions or in automatic dishwashing rinse aid compositions is substantially eliminated.

2. The process of claim 1 wherein the ethoxylated nonionic surfactant and water-soluble $Mg^{++}$ or $Zn^{++}$ ions are added to the rinse solution by addition of a liquid rinse aid composition comprising:

(a) from about 1% to about 40% by weight of a low foaming ethoxylated nonionic surfactant;
(b) from 0% to about 30% by weight of an organic chelating agent;
(c) from about 0.1% to about 10% by weight of $Mg^{++}$ or $Zn^{++}$ ions or mixtures thereof, said ions being present in the form of a water-soluble salt thereof; and
(d) a hydrotrope-water solubilizing system.

* * * * *